US006505465B2

(12) United States Patent
Kanazawa et al.

(10) Patent No.: US 6,505,465 B2
(45) Date of Patent: Jan. 14, 2003

(54) DEVICE FOR CONTROLLING AN INTERNAL COMBUSTION ENGINE

(75) Inventors: Yukiko Kanazawa, Tokyo (JP); Hideaki Katashiba, Tokyo (JP); Kazuhiko Kawajiri, Tokyo (JP); Takashi Yonezawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/901,064

(22) Filed: Jul. 10, 2001

(65) Prior Publication Data

US 2002/0112469 A1 Aug. 22, 2002

(30) Foreign Application Priority Data

Dec. 25, 2000 (JP) ..... 2000-393090

(51) Int. Cl.[7] ..... F02M 25/06

(52) U.S. Cl. ..... 60/278; 60/274; 60/285; 123/406.48

(58) Field of Search ..... 60/274, 276, 277, 60/285, 278, 286; 123/406.48, 519

(56) References Cited

U.S. PATENT DOCUMENTS 5,437,153 A * 8/1995 Takeshima et al. ..... 60/285
5,595,060 A * 1/1997 Togai et al. ..... 60/274
5,655,363 A * 8/1997 Ito et al. ..... 60/276
5,894,725 A * 4/1999 Cullen et al. ..... 60/285
5,956,948 A * 9/1999 Nagashima et al. ..... 60/285
6,012,435 A * 1/2000 Takahashi et al. ..... 123/519
6,199,372 B1 * 3/2001 Wakamoto ..... 60/276
6,279,537 B1 * 8/2001 Yonekura et al. ..... 123/406.48

FOREIGN PATENT DOCUMENTS

JP 93/25806 12/1993 ..... F01N/3/28

* cited by examiner

*Primary Examiner*—Thomas Denion
*Assistant Examiner*—Tu M. Nguyen
(74) *Attorney, Agent, or Firm*—Sughrue Mion, PLLC

(57) ABSTRACT

A device for controlling an internal combustion engine capable of estimating the amount of NOx emission within short periods of time maintaining high precision and realizing improved control performance without increasing the cost as a result of not using map data in the ROM. The device includes NOx operation circuit for estimating the amount of NOx in the exhaust gas from a theoretical formula and an empirical formula based upon the intake air amount Qa, intake air temperature To, pressure Pb, air-fuel ratio λ and EGR rate β, and control circuit for controlling at least either the NOx purifying catalyst or the combustion state in the internal combustion engine in order to lower the amount of NOx emission.

8 Claims, 4 Drawing Sheets

DEVICE FOR CONTROLLING AN INTERNAL COMBUSTION ENGINE

BACKGROUND OF THE INVENTION

1. Field of the Invention

The present invention relates to a device for controlling an internal combustion engine by using a NOx purifying catalyst to reduce NOx (nitrogen oxides) in the exhaust gas. More particularly, the invention relates to a device for controlling an internal combustion engine capable of estimating the amount of NOx emission within short periods of time maintaining high precision and realizing improved control performance without increasing the cost that results when a memory having a large capacity is used.

2. Prior Art

Devices for controlling internal combustion engines of this kind have heretofore been provided with NOx amount estimating means for estimating the amount of NOx adsorbed by a NOx adsorbing agent as taught in, for example, Japanese Patent No. 2586739.

FIG. 3 is a block diagram illustrating the constitution of a conventional device that is adapted to a gasoline engine.

To avoid complexity, here, the description deals with one cylinder only. It should, however, be noted that the same constitution applies to plural cylinders.

In FIG. 3, an internal combustion engine 1 includes a piston 2, a combustion chamber 3, a spark plug 4, an intake valve 5, an intake port 6, an exhaust valve 7 and an exhaust port 8.

The intake port 6 is coupled to a surge tank 10 through a corresponding intake pipe 9 which is provided with a fuel injection valve 11 for injecting fuel into the intake port 6.

The surge tank 10 is coupled to an air cleaner 13 through an intake duct 12 in which a throttle valve 14 is disposed. The intake duct 12 is further provided with an air flow sensor (not shown) for detecting the amount of the air taken in.

On the other hand, the exhaust port 8 is connected, through an exhaust manifold 15 and an exhaust pipe 16, to a casing 18 in which a NOx adsorbing agent 17 is contained.

The NOx adsorbing agent 17 adsorbs NOx in the exhaust gas and works as a NOx purifying catalyst.

An electronic control unit (ECU) 30 comprises a digital computer which includes a ROM 32, a RAM 33, a CPU 34, an input port 35 and an output port 36 which are connected to each other through a bidirectional bus 31, as well as A/D converters 37, 38 inserted on the input side of the input port 35 and drive circuits 39 inserted on the output side of the output port 36.

A pressure sensor 19 is mounted in the surge tank 10 to generate an output voltage in proportion to an absolute pressure in the surge tank 10. An output voltage of the pressure sensor 19 is fed to the input port 35 through the A/D converter 37.

An air-fuel ratio sensor 25 is mounted on the exhaust pipe 16. An output voltage of the air-fuel ratio sensor 25 is fed to the input port 35 through the A/D converter 38.

Further, a known EGR pipe (not shown) is provided between the exhaust pipe 16 and the intake pipe 9 to recirculate part of the exhaust gas. The EGR pipe is provided with an EGR valve for adjusting the EGR amount.

An idle switch 20 is attached to the throttle valve 14 to detect the idle opening degree of the throttle valve 14. An output signal of the idle switch 20 is input to the input port 35. Similarly, an output signal (engine rotational speed Ne) of a rotational speed sensor 26 is fed to the input port 35.

The operation of the conventional device shown in FIG. 3 will be briefly described below with reference to FIGS. 4 and 5. The control operation of the conventional device is as disclosed in detail in the above-mentioned patent publication, and is not described here.

The CPU 34 in the ECU 30 constitutes NOx amount estimating means in cooperation with the ROM 32 and RAM 33, and estimates the amount of NOx adsorbed by the NOx adsorbing agent 17.

It is difficult to directly detect the amount of NOx adsorbed by the NOx adsorbing agent 17. Therefore, the amount of NOx in the exhaust gas emitted from the engine 1 is found to estimate the amount of NOx adsorbed by the NOx adsorbing agent 17 from the amount of NOx in the exhaust gas.

In general, the amount of the exhaust gas emitted from the engine 1 per a unit time increases with an increase in the engine rotational speed Ne. Accordingly, the amount of NOx emitted from the engine 1 per a unit time increases with an increase in the engine rotational speed Ne.

Further, as the engine load increases (i.e., as the absolute pressure PM in the surge tank 10 increases), the amount of the exhaust gas emitted from the combustion chamber 3 increases and the combustion temperature increases. As the engine load increases (absolute pressure PM in the surge tank 10 increases), therefore, the amount of NOx emitted from the engine 1 per a unit time increases.

FIG. 4 is a diagram illustrating the amount of NOx emitted from the engine 1 per a unit time, and wherein the values found through experiment are related to the absolute pressure PM (ordinate) in the surge tank 10 and the engine rotational speed Ne (abscissa).

In FIG. 4, the continuous curves represent the same amounts of NOx.

As shown in FIG. 4, the amount of NOx emitted from the engine 1 per a unit time increases with an increase in the absolute pressure PM in the surge tank 10 and with an increase in the engine rotational speed Ne.

The amounts of NOx shown in FIG. 4 have been stored in advance in the ROM 32 in the form of map data N11 to Nij shown in FIG. 5.

The map data shown in FIG. 5 vary depending upon other various operating conditions. When it is attempted to correctly find the amount of NOx by operating the map, a large amount of memory capacity is necessary driving up the cost.

According to the conventional device of controlling the internal combustion engine as described above, the data used by the NOx amount estimating means in the ECU 30 are stored as map data N11 to Nij as shown in FIG. 5. Therefore, the map data must be formed for every operating condition of the engine 1 and must be stored in the ROM 32, requiring laborious work and extended periods of time and driving up the cost.

SUMMARY OF THE INVENTION

The present invention was accomplished in order to solve the above-mentioned problem, and has an object of providing a device for controlling an internal combustion engine by estimating the amount of NOx emission within short periods of time maintaining high precision and improving control performance without the need of storing great amounts of map data in the ROM and, hence, without driving up the cost.

A device for controlling an internal combustion engine according to the present invention comprises:

an air flow sensor provided in an intake pipe of the internal combustion engine to detect the amount of the intake air;

temperature detector means and pressure detector means for detecting the temperature and the pressure of the air taken in by the internal combustion engine;

air-fuel ratio detector means provided in the exhaust pipe of the internal combustion engine and for detecting the air-fuel ratio in the exhaust gas;

EGR rate detector means for detecting the EGR rate of the exhaust gas recirculated into the intake air;

a NOx purifying catalyst provided in the exhaust pipe of the internal combustion engine;

NOx operation means for estimating the amount of NOx in the exhaust gas from a theoretical formula and an empirical formula based upon the amount of the intake air, temperature and pressure of the intake air, air-fuel ratio and EGR rate; and control means for controlling at least either the NOx purifying catalyst or the combustion state in the internal combustion engine in order to lower the amount of NOx emission.

In the device for controlling an internal combustion engine according to the present invention, the theoretical formula and the empirical formula contain a correction coefficient that varies depending upon at least either the model of the internal combustion engine or the combustion mode.

In the device for controlling an internal combustion engine according to the present invention, the combustion mode includes a stratified combustion mode and a homogeneous combustion mode.

In the device for controlling an internal combustion engine according to the present invention, the NOx operation means estimates the oxygen concentration, nitrogen concentration and temperature of the combustion gas in the internal combustion engine from the theoretical formula and the empirical formula, and estimates the amount of NOx emission in the exhaust gas based upon the oxygen concentration, nitrogen concentration and temperature of the combustion gas.

In the device for controlling an internal combustion engine according to the present invention, the control means controls the air-fuel ratio to control the NOx purifying catalyst.

In the device for controlling an internal combustion engine according to the present invention, the control means controls at least one of the fuel injection amount, fuel injection timing, ignition timing and EGR rate of the internal combustion engine as the combustion state of the internal combustion engine.

In the device for controlling an internal combustion engine according to the present invention, the air-fuel ratio detector means includes:

an air-fuel ratio sensor provided in the exhaust pipe upstream of the NOx purifying catalyst and for producing an oxygen concentration detection signal depending upon the oxygen concentration in the exhaust gas; and air-fuel ratio operation means for estimating the air-fuel ratio based upon the oxygen concentration detection signal.

In the device for controlling an internal combustion engine according to the present invention, the air-fuel ratio detector means includes air-fuel ratio operation means for estimating the air-fuel ratio from the fuel injection amount and from the intake air amount of the internal combustion engine.

DESCRIPTION OF THE PREFERRED EMBODIMENTS

Embodiment 1

An embodiment 1 of the present invention will now be described in detail with reference to the drawings.

Figure 1:
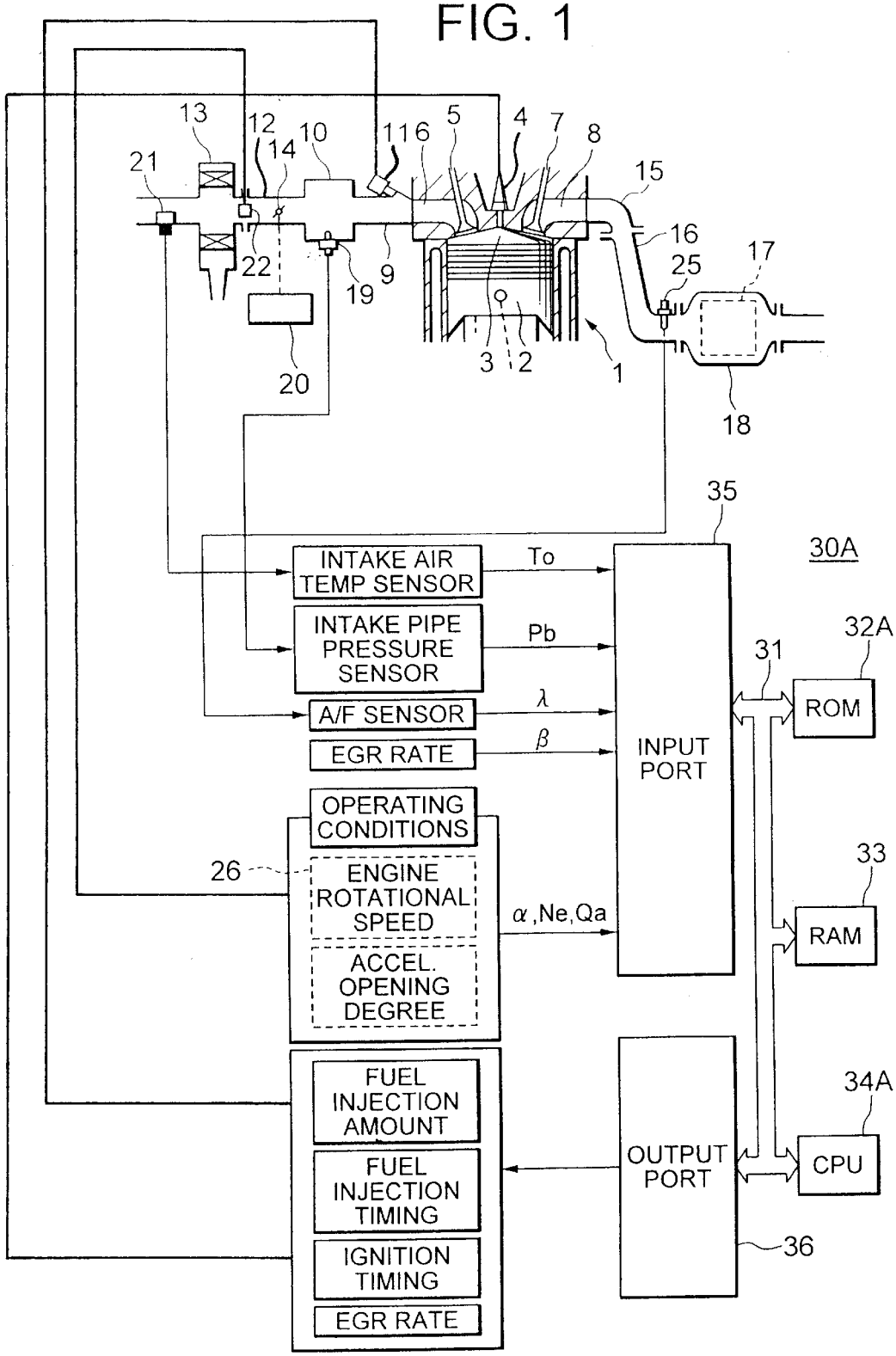
FIG. 1 is a block diagram illustrating the constitution of an embodiment 1 of the present invention.
Figure 3:
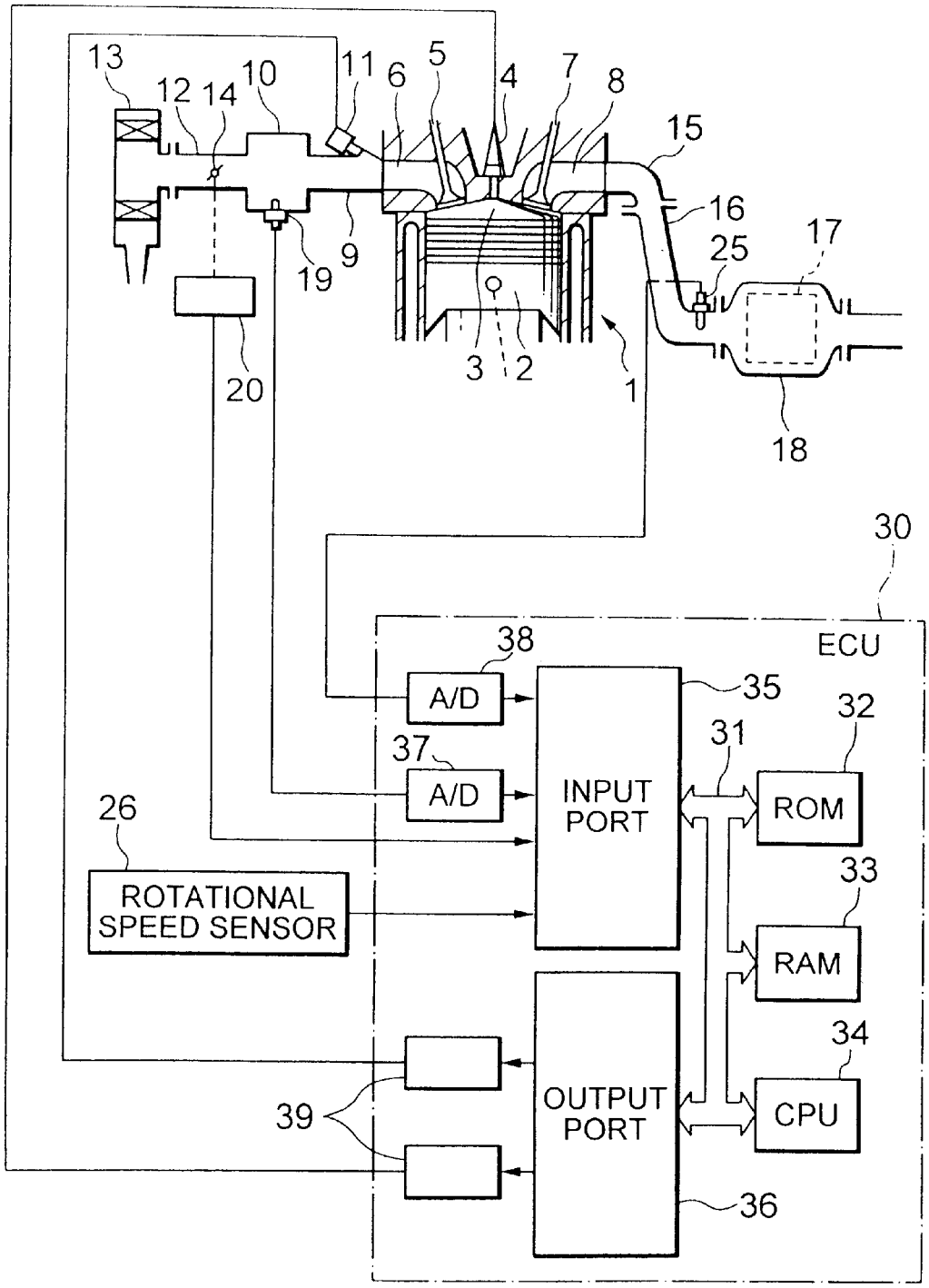
FIG. 3 (PRIOR ART)
FIG. 3 is a block diagram illustrating the constitution of a conventional device for controlling an internal combustion engine.
Figure 4:
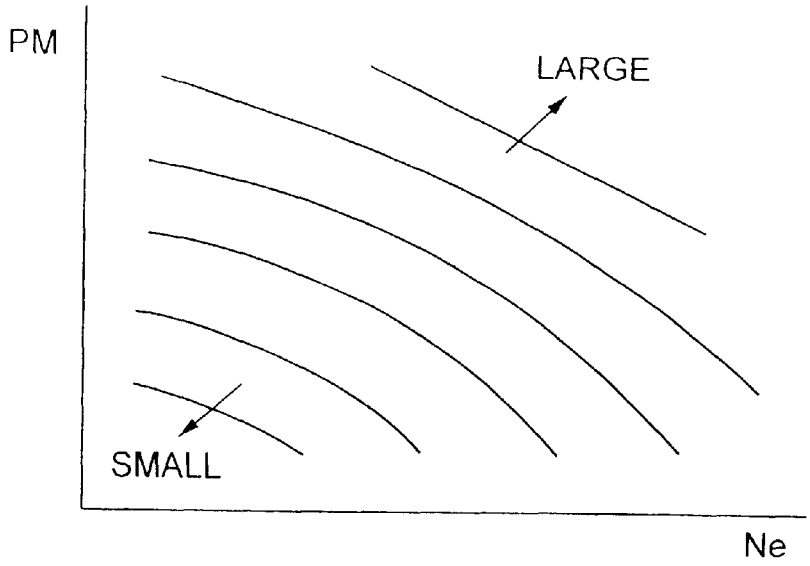
FIG. 4 (PRIOR ART)
FIG. 4 is a diagram illustrating the amount of NOx emitted by a general internal combustion engine per a unit time.
Figure 5:
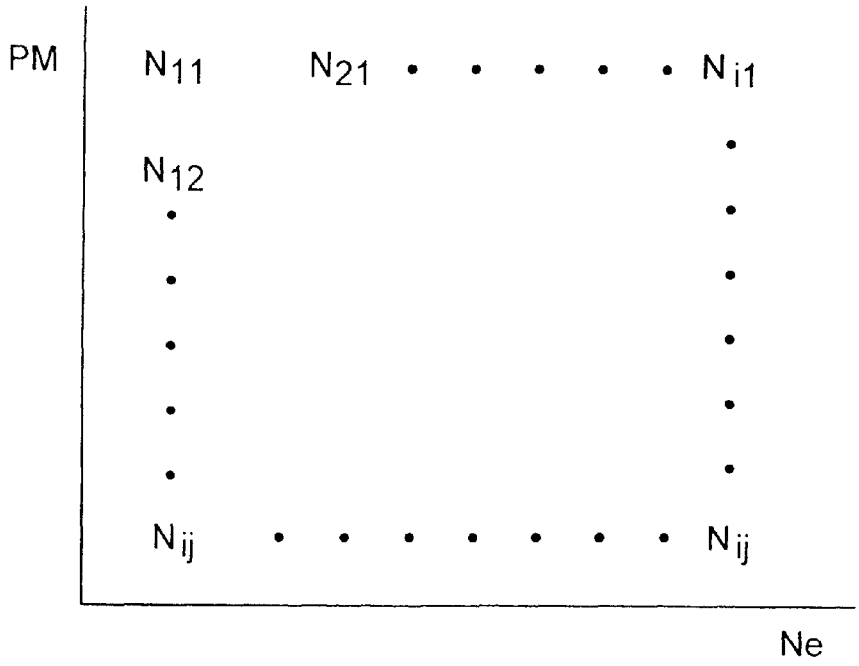
FIG. 5 (PRIOR ART)
FIG. 5 is a diagram illustrating map data representing the amounts of NOx emission by using a conventional device for controlling the internal combustion engine.

FIG. 1 is a block diagram illustrating the constitution of the embodiment 1 of the present invention, wherein the same portions as those described above (see FIG. 3) are denoted by the same reference numerals or by putting "A" to the ends of the numerals but are not desired here again in detail.

For simplifying the diagram, the A/D converters 37, 38 and the drive circuits 39 (see FIG. 3) in the ECU 30A are not shown here.

In FIG. 1, an intake air temperature sensor 21 is provided on the upstream of the air cleaner 13 in the intake pipe 9 to detect the temperature To of the intake air.

Further, an air flow sensor 22 is provided on the downstream of the air cleaner 13 in the intake pipe 9 to detect the flow rate Qa of the intake air.

The pressure sensor 19 detects the pressure Pb in the intake pipe 9 as the pressure of the intake air, and substantially works as an intake-air-pressure sensor.

The intake air pressure Pb, intake air temperature To and intake air flow rate Qa are fed, together with the air-fuel ratio $\lambda$ from the air-fuel ratio sensor 25, to the input port 35 in the ECU 30A as various sensor data representing the operating conditions of the engine 1.

As various sensor means, further, there is provided an EGR sensor for detecting the EGR rate from the opening degree $\beta$ of the EGR valve that adjusts the EGR amount in the EGR pipe (not shown). The EGR rate representing the amount of the exhaust gas recirculated into the intake air is fed to the input port 35.

As operating conditions, further, not only the engine rotational speed Ne and the accelerator opening degree $\alpha$ but also the intake air amount Qa from the air flow sensor, are fed to the input port 35.

The CPU 34A in the ECU 30A includes NOx operation means for estimating the amount of NOx emission in the exhaust gas from a theoretical formula and an empirical formula (described later) based upon the intake air amount Qa, intake air temperature To, intake air pressure Pb and upon the air-fuel ratio $\lambda$ and the EGR rate (EGR opening degree $\beta$).

The CPU 34A includes control means for controlling at least either the NOx purifying catalyst 17 or the combustion state in the engine 1 so as to decrease the amount of NOx emission.

Here, the theoretical formula and the empirical formula contain a correction coefficient that has been stored in advance in the ROM 32A and that varies depending upon at least either the model of the engine 1 or the combustion mode.

The combustion modes may include a stratified combustion mode of the case of an direct cylinder injection engine and a homogeneous combustion mode during the normal stoichiometric operation control.

The NOx operation means in the CPU 34A estimates the oxygen concentration, nitrogen concentration and temperature of the combustion gas in the engine 1 from the theoretical formula and the empirical formula, and estimates the amount of NOx emission in the exhaust gas based upon the oxygen concentration, nitrogen concentration and temperature of the combustion gas.

The control means in the CPU 34A controls the air-fuel ratio λ to control the NOx purifying catalyst 17.

The control means in the CPU 34A further controls at least one of the fuel injection amount, fuel injection timing, ignition timing and EGR rate of the engine 1 as the combustion state of the engine 1.

As shown, the air-fuel ratio detector means is constituted by an air-fuel ratio sensor 25 provided in the exhaust pipe 16 upstream of the NOx purifying catalyst 17 and for producing an oxygen concentration detection signal depending upon the oxygen concentration in the exhaust gas, and air-fuel ratio operation means in the CPU 34A for estimating the air-fuel ratio A/F based upon the oxygen concentration detection signal.

Further, the air-fuel ratio detector means may be constituted by air-fuel ratio operation means in the CPU 34A for estimating the air-fuel ratio A/F from the fuel injection amount and the intake air amount Qa of the engine 1.

Next, described below is the operation for estimating the amount of NOx emission according to the embodiment 1 of the present invention shown in FIG. 1.

First, NOx (nitrogen oxide) formed by the engine 1 comprises chiefly Zeldvich NO (nitrogen monoxide), the reaction mechanism being expressed by the following formulas (1) and (2), $$N2+O \rightarrow NO+N \tag{1}$$

$$N+O2 \rightarrow NO+O \tag{2}$$

The rate of NO formation based on the above formulas (1) and (2) is expressed by the following formulas (3) and (4), $$\frac{d[NO]}{dt} = k[N2][O2]^{1/2}\ (\mathrm{kmol/m^3\,s}) \tag{3}$$

$$k = 4.52 \times 10^{15} T^{-1/2} \exp\left(-\frac{69460}{T}\right) \tag{4}$$

In the formula (3), [NO], [N2] and [O2] are concentrations of NO, N2 (nitrogen) and O2 (oxygen) and in the formula (4), T is a temperature.

The combustion reaction mechanism in the engine 1 is expressed by the following formula (5), $$C8H18 + \frac{\lambda}{15}(12.5\,O2 + 47\,N2) + \tag{5}$$

-continued $$\beta\left\{8CO2 + 9H2O + 12.5\left(\frac{\lambda}{15} - 1\right)O2 + 47\frac{\lambda}{15}N2\right\} \rightarrow$$

$$(1+\beta)\left\{8CO2 + 9H2O + 12.5\left(\frac{\lambda}{15} - 1\right)O2 + 47\frac{\lambda}{15}N2\right\}$$

In the formula (5), β is an EGR rate and λ is an air-fuel ratio.

The concentrations [N2] and [O2](kmol/m3] of N2 and O2 are expressed by the following formulas (6) and (7), $$[N2] = \frac{47(\lambda/15)(1+\beta)\varepsilon\,P\times 273/T_0}{22.4(1+\beta)(4.5+59.5(\lambda/15))} = \frac{47(\lambda/15)\varepsilon\,P\times 273/T_0}{22.4(4.5+59.5(\lambda/15))} \tag{6}$$

$$[O2] = \frac{12.5((\lambda/15)-1)(1+\beta)\varepsilon\,P\times 273/T_0}{22.4(1+\beta)(4.5+59.5(\lambda/15))} = \frac{0.558\times((\lambda/15)-1)\varepsilon\,P\times 273/T_0}{(4.5+59.5(\lambda/15))} \tag{7}$$

In the formulas (6) and (7), ε is a compression ratio, P (atom) is an intake air pressure, and To (K) is an intake air temperature.

Further, the nitrogen concentration [N2] is approximately expressed by the following formula (8), $$[N2] = \frac{47\varepsilon P\times 273/T_0}{22.4\times 64} = \frac{8.95\varepsilon P}{T_0} \tag{8}$$

From the above formulas (3), (4), (7) and (8), the concentration [NO] of NO emitted per a stroke (per a combustion) is expressed by the following formulas (9) and (10), $$[NO] = \frac{60}{n_E}\times 4.52\times 10^{15}\times T^{-1/2}\exp\left(-\frac{69460}{T}\right)\times\frac{8.95\,\varepsilon P}{T_0}\times\left(\frac{0.558\times((\lambda/15)-1)\varepsilon P\times 273/T_0}{4.5+59.5(\lambda/15)}\right)^{1/2}(\mathrm{kmol/m^3}) \tag{9}$$

$$= \frac{3.0\times 10^{19}}{n_E}T^{-1/2}\exp\left(-\frac{69460}{T}\right)\times\left(\frac{(\lambda/15)-1}{4.5+59.5(\lambda/15)}\right)^{1/2}\varepsilon^{3/2}p^{3/2}T_0^{-3/2} \tag{10}$$

In the above formulas (9) and (10), nE (rpm) is an engine rotational speed Ne.

Here, if the amount of fuel injection per a stroke is denoted by Gf (kg), the amount of NO Gno(kg) emitted by a four-cycle engine per a stroke is expressed by the following formulas (11) and (12), $$G_{no} = \frac{[NO]}{2}(\mathrm{kmol/m^3})\times M_{NO}(\mathrm{kg/kmol})\times \text{amount of exhaust gas } (\mathrm{m^3})$$

-continued $$= \frac{3.0 \times 10^{19}}{2n_E} T^{-1/2} \exp\left\{-\frac{69460}{T}\right\} \times \left\{\left[\frac{(\lambda/15)-1}{4.5+59.5(\lambda/15)}\right]\right\}^{1/2} \times \varepsilon^{3/2} \times P^{3/2} \times T_0^{-3/2} \times 30 \times \left\{\frac{G_f}{114} \times \left\{4.5 + 59.5\frac{\lambda}{15}\right\} \times 22.4\right\} (\text{kg}) \quad (11)$$

$$= \frac{8.84 \times 10^{19}}{n_E} T^{-1/2} \exp\left\{-\frac{64900}{T}\right\} \times \{((\lambda/15)-1)(4.5+59.5(\lambda/15))\}^{1/2} \times G_f \times \varepsilon^{3/2} \times P^{3/2} \times T_0^{-3/2} (\text{kg}) \quad (12)$$

Further, a total amount of NO GnoT (kg) emitted per a unit time is expressed by the following formulas (13) and (14), $$G_{noT} = CG_{no}\frac{n_E}{60} \quad (13)$$

$$= 14.7 \times 10^{17} \times T^{-1/2} \exp\left\{-\frac{64900}{T}\right\} \times \{(\lambda/15-1)(4.5+59.5(\lambda/15))\}^{1/2} \times G_f \times \varepsilon^{3/2} \times P^{3/2} \times T_0^{-3/2} \times C\,(\text{kg/s}) \quad (14)$$

In formulas (13) and (14), C is a correction coefficient.

As the temperature T, there is typically employed a maximum adiabatic frame temperature of the case where there is no heat loss. The flame temperature T is expressed by the following formulas (15) to (17) by using an average specific heat at constant pressure Cp, an intake air temperature To and a polytropic index κ, $$T = \left(\frac{\Delta H}{c_p G} + T_0\right) \times \varepsilon^{\kappa-1} \quad (15)$$

$$= \left(\frac{10670 \times 0.114}{c_p(1+\beta)\{8 \times 0.044 + 9 \times 0.018 + 12.5(\lambda/15-1) \times 0.032 + 47 \times 0.028(\lambda/15)} + T_0\right) \times \varepsilon^{\kappa-1} \quad (16)$$

$$= \left(\frac{1216}{c_p(1+\beta)(0.114+0.916(\lambda/15))} + T_0\right) \times \varepsilon^{\kappa-1} \quad (17)$$

Cp: average specific heat at constant pressure (kcal/kg° C.),

To: intake air temperature (K),

κ: polytropic index.

Here, the average specific heat at constant pressure Cp is approximated by the following formula (18), $$c_p = 0.518 - 0.219(\lambda/15) + 0.0521(\lambda/15)^2 \quad (18)$$

Accordingly, the flame temperature T is expressed by the following formulas (19) and (20), $$T = \left(\frac{1216}{(0.518 - 0.219(\lambda/15) + (\lambda/15)^2)(1+\beta)(0.114+0.916(\lambda/15))} + T_0\right) \times \varepsilon^{\kappa-1} \quad (19)$$

-continued $$= [1216(1-\beta)\{3.305 - 0.5346(\lambda/15)\} + T_0] \times \varepsilon^{\kappa-1} \quad (20)$$

If the formula (20) is substituted for the above formula (14), there is obtained the following formula (21), $$G_{noT} = 6.88 \times 10^{17} \times ([1216(1-\beta)\{3.305 - 0.5346(\lambda/15)\} + T_0] \times \varepsilon^{\kappa-1})^{-1/2} \times \exp\left\{-\frac{(64900)}{([1216(1-\beta)\{3.305 - 0.5346(\lambda/15)\} + T_0] \times \varepsilon^{\kappa-1})}\right\} \times \{(\lambda/15-1)(4.5+59.5(\lambda/15))\}^{1/2} \times G_f \times \varepsilon^{3/2} \times P^{3/2} \times T_0^{-3/2} \times C\,(\text{kg/s}) \quad (21)$$

The formula (21) can be further approximated as expressed by the following formulas (22) to (24), $$G_{noT} = f(\lambda)g(\beta)h(\epsilon)i(Tb\ 0) \times P^{3/2} \times G_f \times C \quad (22)$$

$$= 14.7 \times 10^{17} \times (-1.839 \times 10^{-7} + 4.2374 \times 10^{-8}\lambda - 3.9847 \times 10^{-9}\lambda^2 + 1.9701 \times 10^{-10}\lambda^3 - 5.415 \times 10^{-12}\lambda^4 + 7.8535 \times 10^{-14}\lambda^5 - 4.698 \times 10^{-16}\lambda^6) \times (1 - 14.27\beta + 69.16\beta^2 - 110.97\beta^3) \times (1.693 - 0.004644T_0 + 7.776 \times 10^{-6}T_0^2) \times (-6.26 + 1.98\epsilon) \times P^{3/2} \times G_f \times C \quad (23)$$

$$G_{noT} = f(\lambda)g(\beta)h(\epsilon)i(T0) \times P^{3/2} \times G_f \times C = (-1.839 \times 10^{-7} \times 4.2374 \times 10^{-8}\lambda - 3.9847 \times 10^{-9}\lambda^2 + 1.9701 \times 10^{-10}\lambda^3 - 5.415 \times 10^{-12}\lambda^4 + 7.8535 \times 10^{-14}\lambda^5 - 4.698 \times 10^{-16}\lambda^6) \times (1 - 14.27\beta + 69.16\beta^2 - 110.97\beta^3) \times (1.693 - 0.004644T_0 + 7.776 \times 10^{-6}T_0^2) \times (-6.26 + 1.98\epsilon) \times P^{3/2} \times G_f \times C_0 \quad (24)$$

In the formulas (22) to (24), C and C0 are correction coefficients which vary depending upon the model of the engine 1 and the combustion mode (stratified combustion, homogeneous combustion).

The amount of NOx emitted per a unit time is calculated based on the formula (21), (23) or (24) from the thus detected air-fuel ratio λ, EGR rate β, intake air pressure Pb and intake air temperature To, and is integrated to estimate the total amount of NOx emission QNT as expressed by the following formula (25) and (26), $$QNT = \int G_{noT}\,dt \quad (25)$$

$$= \Sigma G_{noT}\Delta t \quad (26)$$

Next, the procedure for processing NOx according to the embodiment 1 of the invention will be described with reference to a flowchart of FIG. 2.

Figure 2:
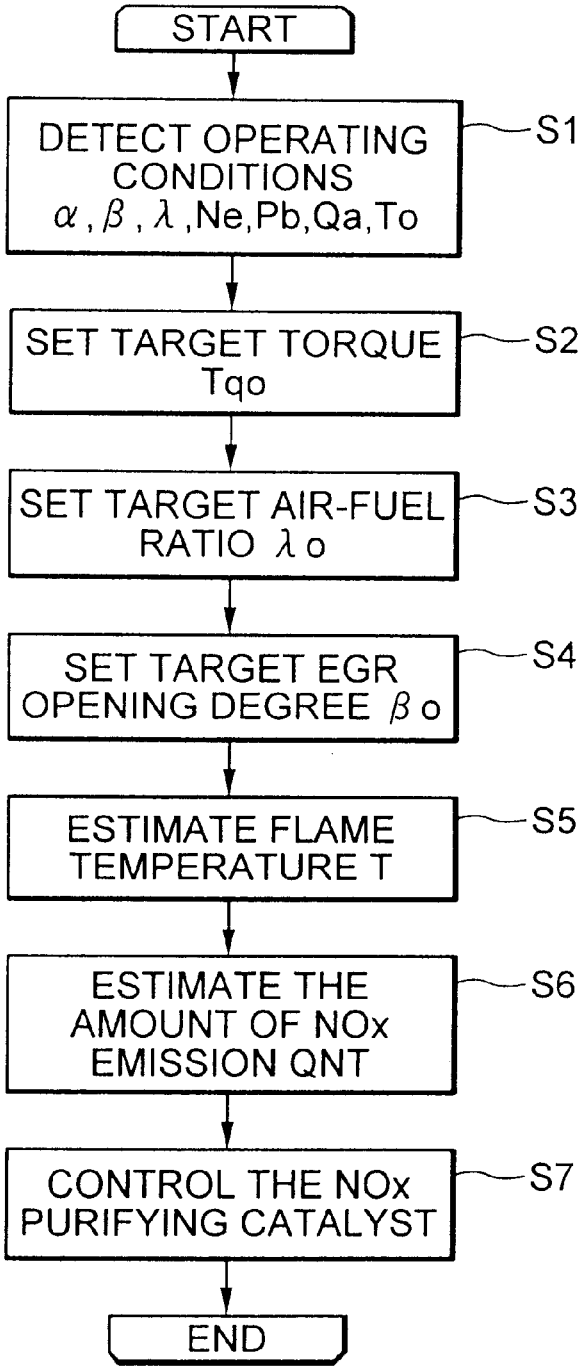
FIG. 2 is a flowchart illustrating the estimation processing operation and the control operation according to the embodiment 1 of the present invention.

In FIG. 2, first, operating conditions (accelerator opening degree α, EGR rate β, air-fuel ratio γ, engine rotational speed Ne, intake pipe pressure Pb, intake air amount Qa, intake air temperature To, etc.) of the engine 1 are detected from various sensor means (step S1).

Then, depending upon the operating conditions, a target torque Tqo is set (step S2), a target air-fuel ratio λo is set (step S3), and a target EGR opening degree βo is set (step S4).

Next, the NOx (NO) concentration [NO], oxygen concentration [O2] and nitrogen concentration [N2] in the combustion gas of the engine 1 are estimated in compliance with the above formulas (6) to (10), and a maximum adiabatic flame temperature T of when there is no heat loss is estimated as the temperature of the combustion gas in compliance with the formulas (19) and (20) (step S5).

Thereafter, the amount of NOx emission QNT in the exhaust gas is estimated in compliance with the above formulas (22) to (26) based on the oxygen concentration [O2], nitrogen concentration [N2] and the combustion gas temperature T (step S6), and the air-fuel ratio λ is controlled and the NOx purifying catalyst 17 is controlled to purify the amount of NOx emission QNT (step S7).

By using the theoretical formula and empirical formula based upon the air-fuel ratio λ, EGR rate β, intake air pressure Pb and intake air temperature To from various sensor means, it is allowed to operate the amount of NOx emission QNT within short periods of time and highly precisely without increasing the memory capacity.

That is, there is no need of forming a great amount of data to meet various operation modes, and the adjustment may be effected depending upon the combustion mode (stratified combustion, homogeneous combustion) and by using several correction coefficients (e.g., see C of the formula 23)) corresponding to a change in the model of the engine 1. Thus, the control operation can be executed depending upon the individual engines 1 easily and in short periods of time.

Therefore, the NOx purifying catalyst 17 is effectively controlled depending upon the amount of NOx emission QNT that is highly precisely estimated within a short period of time thereby to decrease the amount of NOx emission QNT.

The NOx purifying catalyst 17 was controlled above depending upon the amount of NOx emission QNT. It is, however, also allowable to control the combustion condition operation quantities of the engine 1 so as to decrease the amount of NOx emission QNT.

In this case, the combustion condition operation quantities controlled by the ECU 30 include a fuel injection amount, a fuel injection timing, an ignition timing and an EGR rate shown in FIG. 1.

Further, the air-fuel ratio sensor 25 provided in the exhaust pipe 15 on the upstream of the NOx purifying catalyst 17 was used as the air-fuel ratio detector means. The operation, however, may be executed by using the intake air amount Qa from the air flow sensor 22 provided in the intake pipe 9 and the fuel injection quantity controlled by the ECU 30A.

In this case, the air-fuel ratio λ is estimated in the ECU 30A from the air flow rate detection value Qa and the fuel injection amount (control quantity of the ECU 30A).

Further, the NOx absorbing agent 17 was used as the NOx purifying catalyst. It is, however, also allowable to use any other NOx purifying catalyst.

What is claimed is:

1. A device for controlling an internal combustion engine comprising:

an air flow sensor provided in an intake pipe of the internal combustion engine to detect the amount of the intake air;

temperature detector means and pressure detector means for detecting the temperature and the pressure of the air taken in by said internal combustion engine;

air-fuel ratio detector means provided in the exhaust pipe of said internal combustion engine and for detecting the air-fuel ratio in the exhaust gas;

EGR rate detector means for detecting the EGR rate of the exhaust gas recirculated into the intake air;

a NOx purifying catalyst provided in the exhaust pipe of said internal combustion engine;

NOx operation means for estimating the amount of NOx in the exhaust gas from a theoretical formula and an empirical formula based upon the amount of the intake air, temperature and pressure of the intake air, air-fuel ratio and EGR rate; and control means for controlling at least either said NOx purifying catalyst or a combustion state in said internal combustion engine in order to lower the amount of NOx emission wherein said NOx operation means estimates the oxygen concentration, nitrogen concentration and temperature of the combustion gas in said internal combustion engine from said theoretical formula and said empirical formula, and estimates the amount of NOx emission in the exhaust gas based upon said oxygen concentration, nitrogen concentration and temperature of the combustion gas.

2. A device for controlling an internal combustion engine according to claim 1, wherein said control means controls the air-fuel ratio to control said NOx purifying catalyst.

3. A device for controlling an internal combustion engine according to claim 1, wherein said control means at least one of said fuel injection amount, fuel injection timing, ignition timing and EGR rate of said internal combustion engine as the combustion state of said internal combustion engine.

4. A device for controlling an internal combustion engine according to claim 1, wherein said air-fuel ratio detector means includes:

an air-fuel ratio sensor provided in the exhaust pipe upstream of said NOx purifying catalyst and for producing an oxygen concentration detection signal depending upon the oxygen concentration in the exhaust gas; and air-fuel ratio operation means for estimating the air-fuel ratio based upon said oxygen concentration detection signal.

5. A device for controlling an internal combustion engine according to claim 1, wherein said air-fuel ratio detector means includes air-fuel ratio operation means for estimating the air-fuel ratio from the fuel injection amount and from the intake air amount of said internal combustion engine.

6. A device for controlling an internal combustion engine according to claim 1, wherein said theoretical formula and said empirical formula contain a correction coefficient that varies depending upon at least either a model of said internal combustion engine or a combustion mode.

7. A device for controlling an internal combustion engine according to claim 6, wherein said combustion mode includes a stratified combustion mode and a homogeneous combustion mode.

8. A method for controlling at least either a NOx purifying catalyst or a combustion state in an internal combustion engine comprising:

detecting an amount of intake air;

detecting a temperature and pressure of air taken in by said internal combustion engine;

detecting an air-fuel ratio in exhaust gas;

detecting an EGR rate of the exhaust gas recirculated into the intake air;

estimating the amount of NOx in the exhaust gas from a theoretical formula and an empirical formula based upon the detected amounts of the intake air, temperature and pressure of the intake air, air-fuel ratio and EGR rate; wherein said theoretical formula and said empirical formula contain a correction coefficient that varies depending upon at least either a model of said internal combustion engine or a combustion mode; and controlling at least either said NOx purifying catalyst or a combustion state in said internal combustion engine in order to lower the amount of NOx emission;

wherein said estimating step estimates the oxygen concentration, nitrogen concentration and temperature of the combustion gas in said internal combustion engine from said theoretical formula and said empirical formula, and estimates the amount of NOx emission in the exhaust gas based upon said oxygen concentration, nitrogen concentration and temperature of the combustion gas.

* * * * *